US008844332B2

(12) United States Patent
Freerk

(10) Patent No.: US 8,844,332 B2
(45) Date of Patent: Sep. 30, 2014

(54) DEVICE FOR THE SUPERPLASTIC FORMING OF A BLANK

(75) Inventor: Syassen Freerk, Stadland (DE)

(73) Assignee: Airbus Operations GmbH, Hamburg (DE)

( * ) Notice: Subject to any disclaimer, the term of this patent is extended or adjusted under 35 U.S.C. 154(b) by 0 days.

(21) Appl. No.: 14/116,769

(22) PCT Filed: May 25, 2012

(86) PCT No.: PCT/EP2012/059856

§ 371 (c)(1),
(2), (4) Date: Nov. 10, 2013

(87) PCT Pub. No.: WO2012/163840

PCT Pub. Date: Dec. 6, 2012

(65) Prior Publication Data

US 2014/0090435 A1 Apr. 3, 2014

Related U.S. Application Data

(60) Provisional application No. 61/490,607, filed on May 27, 2011.

(30) Foreign Application Priority Data

May 27, 2011 (DE) ..... 10 2011 076 645

(51) Int. Cl.
*B21D 26/031* (2011.01)
*B21D 26/055* (2011.01)

(52) U.S. Cl.
CPC ..... *B21D 26/031* (2013.01); *B21D 26/055* (2013.01)
USPC ..... 72/60; 72/56; 72/63

(58) Field of Classification Search
USPC ..... 72/54, 56, 57, 60, 61, 62, 63, 430, 709
See application file for complete search history.

(56) References Cited

U.S. PATENT DOCUMENTS 3,529,458 A * 9/1970 Bowers et al. ..... 72/60
3,993,727 A * 11/1976 Skriletz et al. ..... 29/228

(Continued)

FOREIGN PATENT DOCUMENTS

JP 5177266 7/1993

OTHER PUBLICATIONS

International Search Report, 201-09-06.

*Primary Examiner* — David B Jones
(74) *Attorney, Agent, or Firm* — Greer, Burns & Crain Ltd.

(57) ABSTRACT

A device for the superplastic forming of a blank, in a mould with a lower and an upper mould, into a component. The blank in the mould can be subjected to pressure and temperature, and the blank has perforations, at least in some regions. The lower mould is formed at least partly with a permeable, in particular a gas permeable, drainage layer. As a consequence of the drainage layer, a blank with perforations can be formed directly, i.e., without further aids such as, e.g., a means of sealing, etc. and/or supplementary production operations, in the course of a superplastic forming process into a component, in particular into a suction component for an active aerodynamic surface of an aircraft, with a complex three-dimensional spatial shape. A simple, cost-effective and reliable process is enabled suitable for large production runs of components, which may be spherically curved in at least some regions.

12 Claims, 1 Drawing Sheet

(56) References Cited

U.S. PATENT DOCUMENTS 4,087,037 A 5/1978 Schier et al.
4,301,584 A * 11/1981 Dillner et al. ..... 72/63
4,691,857 A * 9/1987 Friedman ..... 72/63
5,085,068 A * 2/1992 Rhoades et al. ..... 72/60
7,086,268 B2 * 8/2006 Luckey et al. ..... 72/709
2008/0034825 A1 2/2008 Dudziak

* cited by examiner

DEVICE FOR THE SUPERPLASTIC FORMING OF A BLANK

CROSS-REFERENCES TO RELATED APPLICATIONS

This application claims the benefit of the U.S. Provisional Application No. 61/490,607, filed on May 27, 2011, and of the German patent application No. 10 2011 076 645.6 filed on May 27, 2011, the entire disclosures of which are incorporated herein by way of reference.

BACKGROUND OF THE INVENTION

The invention concerns a device for the superplastic forming of a blank, in a moulding tool with a lower mould and an upper mould, into a component, in particular a suction component, with a three-dimensional geometry, wherein for purposes of forming, the blank can be subjected in the mould to pressure and temperature, and the blank has perforations in at least some regions.

For purposes of minimising the fuel consumption of aircraft, in particular of passenger aircraft, the objective is to maintain laminar flow as far as possible over the active aerodynamic surfaces. Such aerodynamic surfaces are, for example, the wings, horizontal tail unit, vertical tail unit, landing flaps, rudder, elevators, and other regions of the aircraft structure. This is because turbulent zones with vortices near the surface increase the drag of the aircraft significantly and impair the energy efficiency. However, not all structural regions of an aircraft can be designed such that the airflow has a laminar profile under all operating conditions.

In order to minimise vortices, in particular near the surface in the region of such active aerodynamic surfaces, suction devices can be deployed. The principle of removal by suction has already been of known art for several decades, wherein proof of function has undoubtedly been obtained. The major problem lies, however, in particular in what has been so far complex implementation in production terms, which still stands in the way of any widespread deployment of this technology in civil aviation. In the region of its relevant incident flow surface such a suction component possesses e.g. fine perforations, via which a proportion of the airflow is sucked off by means of a pumping unit, and by this means a local slightly reduced pressure is composed for purposes of reducing the turbulence. Such components require however an active aerodynamic surface with an extremely complex three-dimensional surface geometry, which in general can only be manufactured with difficulty. Here the superplastic forming method (SPF), which is of known art, but up to the present time is complex in production terms, is deployed in individual cases. In the superplastic forming method a component that is initially approximately plane is formed with the aid of a multi-part moulding tool and with the application of certain pressure and temperature parameters. The temperature to be applied can—depending on the metal or metal alloy to be formed—reach values of up to 1000° C. The forming pressure necessary for the superplastic forming process within the mould is preferably generated by means of a gas, or a noble gas. Here extensions in length of several 100% can be achieved relative to the dimensions of the initial material, wherein by virtue of the superplasticity no necking or cracking occurs and an even wall thickness is maintained. One disadvantage of the superplastic forming method lies in the fact that in order to build up a sufficient forming pressure the initial material must be impermeable to gas. From this it follows that for the manufacture of suction components with complex shapes by means of the superplastic forming processes of known art the perforations must be introduced at a later stage, which increases the complexity of the production process considerably.

DE 44 36 748 C1 shows a method for the superplastic forming of an internally stiffened hollow component with a wall in which at least some regions are perforated.

In this method the initial material to be formed in the course of a superplastic forming process already has perforations. In order nevertheless to be able to build up the necessary forming pressure in the mould, the holes of the perforations are temporarily covered during the forming process by means of a molybdenum foil. One disadvantage of the method lies in the fact that after completion of the forming process the molybdenum foil applied to the perforations must be chemically removed in a complex manner so as to ensure the air permeability of the micro-perforations of the formed suction component.

SUMMARY OF THE INVENTION

It is therefore the object of the invention to create a device that enables an initially essentially plane blank, provided in advance with perforations and/or openings in at least some regions, to be directly formed, i.e. without additional aids and/or further production operations, by means of a superplastic forming process that is significantly simplified in production terms, into a component with a complex three-dimensional shape that is perforated in at least some regions.

This object is achieved by a device with the features of claim 1.

In that the lower mould is designed in at least some parts with a permeable, in particular a gas permeable, drainage layer, direct superplastic forming of a blank, which is also perforated in at least some regions, can be executed without aids, such as, for example, seals etc. For purposes of generating the necessary forming pressure in the device a gas, or a noble gas, such as, for example, argon, neon, or similar, is deployed. By virtue of the superplasticity of the blank when heated up to a high temperature of up to 1000° C. only a relatively low gas pressure is necessary for the forming process. The initially essentially plane panel-shaped blank is preferably formed from aluminium, an aluminium alloy, titanium, or a titanium alloy. The blank can also take the form of a sandwich structure with two surface layers and a reinforcing structure, or core structure, that connects these. After completion of the forming process the blank has, in the ideal case, completely adopted the surface contour of the shape-defining lower mould and thus lies against the latter.

The lower mould can, if required, be configured to be completely porous. In this case the whole of the lower mould consists of a drainage layer.

In accordance with an advantageous development of the device provision is made that the upper mould is connected with a supply unit for a gas.

The supply unit enables a cavity located above the blank to be subjected to the pressurised gas in order to execute the superplastic forming process. The supply unit comprises amongst other items a pump that is suitable for purposes of pumping gas, and also, as required, a heating unit for purposes of heating the gas to the necessary forming temperature.

In a further configuration of the device the drainage layer is connected with a suction unit for the gas. By means of the suction unit the gas passing through the perforations of the blank can be sucked out of a cavity located underneath the blank. The suction unit likewise takes the form of a pump that is suitable for purposes of pumping gas.

In accordance with a development of the device by means of the suction unit at least a volumetric flow of gas passing through the perforations can be removed by suction.

By this means a positive gas pressure always prevails in the cavity above the blank, which is an essential first requirement for the superplastic forming process of the blank. The pumping capacity of the suction unit during the forming process must be at least sufficiently high such that the volumetric flow of gas passing through the perforations of the blank in the ideal case is completely removed. The volumetric flow, as conditioned by the perforations (a so-called "leakage flow") is dependent on, amongst other items, the properties of the perforations of the blank, such as, for example, the size of the openings or holes, the surface extent of the perforations, as well as the grid spacings of the openings, i.e. the hole density. Moreover the volumetric flow, as conditioned by the perforations, also depends on the ratio of the pumping capacity of the supply unit to the pumping capacity of the suction unit. The ratio of the pumping capacity of the supply unit to the pumping capacity of the suction unit is preferably selected such that a sufficiently high (forming) pressure of the gas ensues in the cavity above the blank during the superplastic forming process, and such that this is maintained, i.e. held constant. The result is an adjustment to a static equilibrium between a pressure p1 in the upper cavity and a pressure p2 in the lower cavity, which is a function of, amongst other items, the configuration of the perforations and the pumping capacities of the supply and suction units, although during the superplastic forming process a defined volumetric flow of gas is always flowing through the device.

In a development of the device provision is made that the drainage layer is formed with a surface structure, in particular with a fine mesh weave.

In the ideal case the drainage layer enables even removal by suction of the gas flow that is constantly passing through the perforations of the blank. The surface structure can, for example, be formed with a fine mesh, preferably metallic, "micro-weave", which at least in some regions lies on the inner surface of the lower mould and, if required, is also securely connected with the latter. Instead of a narrow mesh metallic weave, a metallic wire mat, another adequately fine arrangement of wires, or a micro-perforated foil can also be deployed.

In accordance with a further configuration of the device the drainage layer is formed with a porous material, in particular with a sintered material.

Suitable substances for this purpose are, for example, sintered metal or ceramic materials (ceramic foams), with through-passages, or with interconnected cavities to achieve the necessary gas permeability.

In a further advantageous configuration of the invention the drainage layer is an integral component of the lower mould.

By this means a secure location of the drainage layer within the lower mould is ensured. This prevents, for example, any lifting, slipping, or separation, and any associated damage to the drainage layer as the blank is being removed from the mould.

In accordance with a development of the device at least one supply line for the gas is connected to the upper mould, which line is connected with the supply unit.

By this means a connection is created in the first instance between the supply unit and the upper cavity. In the ideal case the at least one supply line moreover ensures an even pressure distribution in the region of the upper cavity. For this purpose the supply lines must be arranged in a suitable distributed manner over the upper mould.

In a further advantageous configuration of the device the lower mould possesses at least one suction line for the gas, which is connected with the drainage layer and with the suction unit.

The suction line connects the drainage layer with the suction unit to enable the removal by suction of the volumetric flow passing through the perforations underneath the blank. A plurality of suction lines distributed in accordance with the geometry of the lower mould are preferably deployed so as to achieve a pressure distribution that is as even as possible in the region of the lower cavity.

In accordance with a further constructive configuration the lower mould and/or the other mould have a heating unit.

The at least one heating unit allows precise control of the temperature of the mould during the superplastic forming process. In this manner perforated blanks of differing material compositions can be formed superplastically within the same device without any problems.

Moreover cooling of the blank that is too rapid is avoided if the latter comes into essentially full contact with the lower mould at the end of the forming process. Furthermore preheating of the blank before the actual superplastic forming process is possible.

DETAILED DESCRIPTION OF THE PREFERRED EMBODIMENTS

In the figures the same design elements have the same reference numbers in each case.

Figure 1:
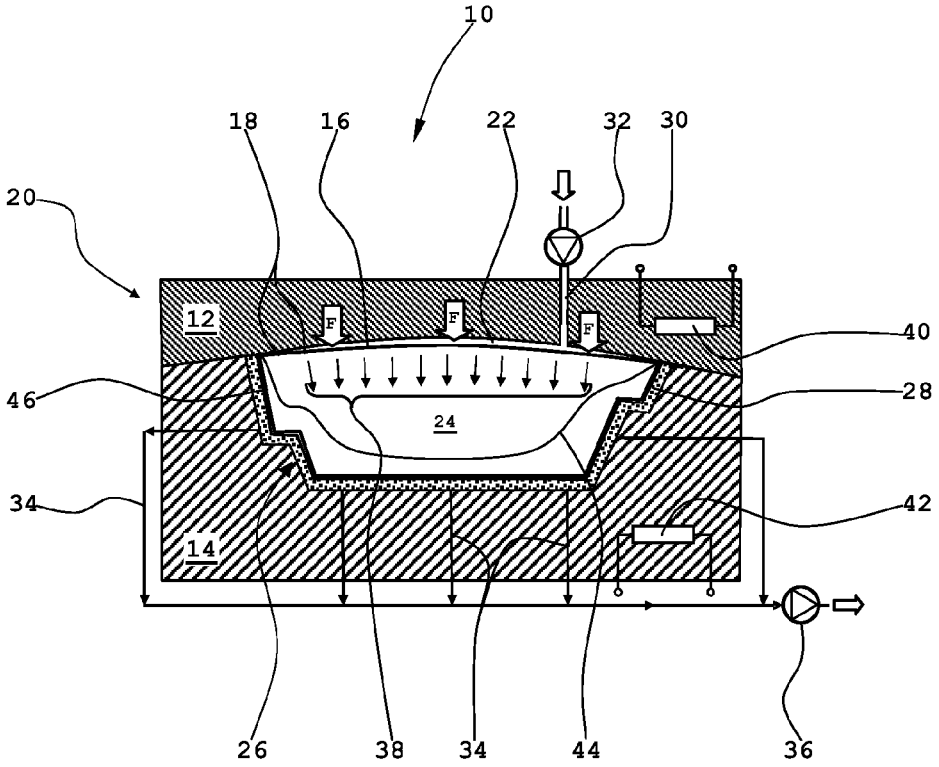
FIG. 1 shows a simplified representation of a device for purposes of superplastic forming, without any aids, of a blank perforated in at least some regions.

FIG. 1 shows the schematic construction of a device for purposes of direct superplastic forming of a blank provided with perforations in at least some regions.

The device 10 comprises, amongst other items, an upper mould 12 and a lower mould 14, between which is accommodated an essentially plane, panel-shaped blank 16, which has perforations 18 in at least some regions. The upper mould 12 and the lower mould 14 together form a moulding tool 20, wherein both the upper mould 12 and also the lower mould 14 can be designed in several parts. The blank 16 is formed with titanium, aluminium, or an alloy of titanium or aluminium. Alternatively other metals, or alloys with other metallic components, can find application, as long as these possess a sufficient superplastic deformability. The blank 16 can, for example, take the form of a panel-shaped metallic sheet, or a hollow structure with a complex geometrical configuration. The hollow structure can, for example, be formed with two metallic surface layers, which are connected by means of a stiffening structure, or core structure (a so-called "sandwich panel"). Other hollow structures or reinforcing structures can likewise be superplastically formed in the device 10. An upper cavity 22 is located above the blank 16, and a lower cavity 24 is located below the blank 16. At the start of the superplastic forming process the upper cavity 22 has a small volume compared with that of the lower cavity 24, wherein this ratio is reversed by the end of the process. The lower mould 14 possesses a multiply stepped depression 26, the surface geometry of which corresponds to that of the component to be manufactured from the blank 16 by means of the superplastic forming process. In the region of the depression 26 a drainage layer 28 is inventively positioned; this is formed with a gas permeable, porous material. The drainage layer 28 can, for example, be formed with a fine mesh weave, not represented in any further detail, and/or with a sintered metallic and/or ceramic material, and/or with a metal foam and/or a ceramic foam, which must, however, possess a sufficient temperature resistance.

The upper mould 12 is connected with a supply unit 32 by means of a supply line 30. The supply unit 32 takes the form of a pump that is suitable for pumping gas. Correspondingly the drainage layer 28 of the lower mould 14 is connected with a suction unit 36 via a plurality of suction lines 34, not individually designated. The suction unit 36 likewise takes the form of a pump that is suitable for pumping gas. With the aid of the supply unit 32 a gas, not represented, for example the noble gas argon or another noble gas, is drawn in, in the direction of the white arrow, and compressed into the upper cavity 22. A proportion of the gas flow supplied passes through the perforations 18 of the blank 16 and forms a volumetric flow 38, which passes through the perforations 18 of the blank 16 in the direction of the black arrows.

Of central importance for the function of the device 10 is the fact that the volumetric flow 38 infiltrating into the lower cavity 24 is as far as possible completely removed from the lower cavity 24 with the aid of the drainage layer 28 and the suction unit 36 that is connected to the latter, so as to build up a sufficient pressure in the region of the upper cavity 22 for the superplastic forming process. The gas pressure present in the region of the upper cavity 22 hereby causes a forming force F, by virtue of whose action the initially essentially plane blank 16 is successively superplastically formed. During the forming process a pressure p1 prevails in the upper cavity 22, while a pressure p2 is present in the lower cavity 24, wherein the pressure p1 is significantly higher than the pressure p2, so as to build up the force F necessary for the forming process. In the course of the superplastic forming process the blank 16 "flows" into the shape-defining depression 26. The temperature of up to 1000° C. that is necessary for the forming process is generated and held constant by two heating units 40, 42 integrated into the upper mould 12 and the lower mould 14. Alternatively or additionally the gas supplied and removed can also be temperature controlled in the region of the supply unit 32 and the suction unit 36 respectively, i.e. in particular it can be heated or cooled.

Initially the blank 16 has an essentially plane configuration, which then passes through an intermediate shape 44 indicated by a thin, dotted line, and finally translates into a suction component 46 that is perforated in at least some regions; in the ideal case the full surface of the latter lies against the shaping depression 26, i.e. the drainage layer 28. At the conclusion of the superplastic forming process the suction component 46 can be removed from the mould by lifting up the upper mould 12 from the lower mould 14. During the whole of the superplastic forming process the pumping capacities of the supply unit 32 and the suction unit 36 must be matched to one another such that a sufficiently high forming force F is acting on the blank 16 for the plastic forming process. For this purpose the device 10 possesses a control and/or regulation unit, not represented, by means of which the supply unit 32, the suction unit 36 and the heating units 40, 42 can be controlled.

In a variant of embodiment that deviates from the representation in FIG. 1 the lower mould 14 can also be designed to be continuously or predominantly porous, i.e. the drainage layer 28 extends over the whole of the lower mould 14, or forms the latter. Depending on the permeability of the drainage layer 28 no removal by suction by means of the suction unit 36 is any longer necessary. Instead the gas passing through the porous mould 14 is simply collected for the purpose of possible recycling, or is temporarily buffer-stored in the latter by accumulation. This process can then be supported or extended as required by means of the suction unit 36 as a function of the reduction in pressure necessary in the region underneath the blank 16.

In a variant of embodiment that is likewise not represented in FIG. 1 the supply unit 32 and the suction unit 36 can be coupled, either directly via a connecting line, or via a connecting line with a gas reservoir interposed, as a result of which the gas can be pumped in an advantageous manner in a cyclical process.

Figure 2:
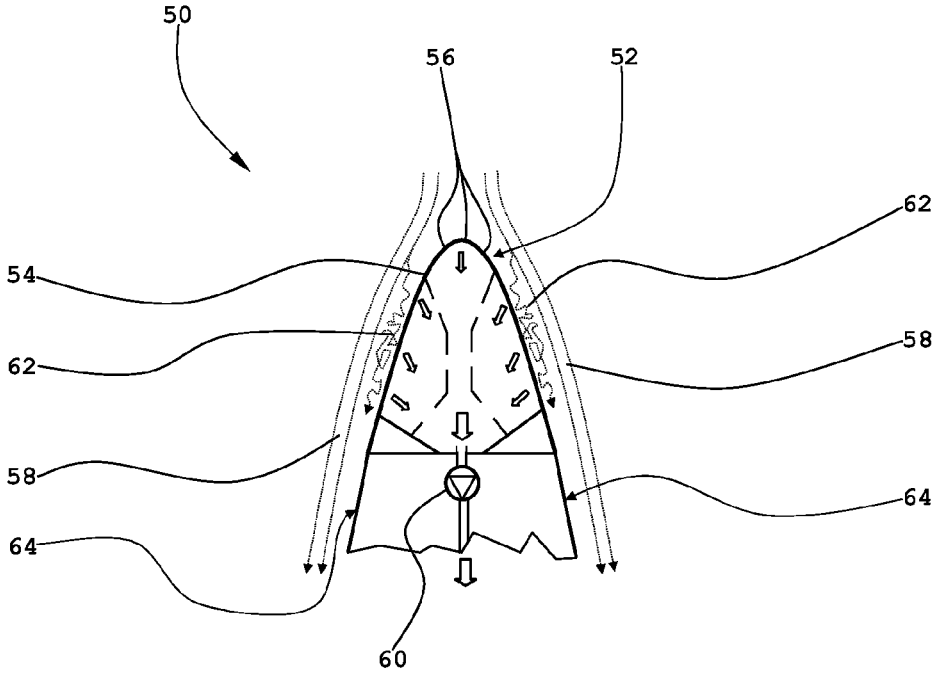
FIG. 2 shows a schematic diagram of a leading edge of an aircraft vertical tail unit, which is fitted with a perforated suction component.

FIG. 2 shows in an exemplary manner a partial representation of a leading edge of a vertical tail unit of an aircraft, which is equipped with a suction component manufactured in the device.

A vertical tail unit 50 with a leading edge 52 is equipped with a suction component 54, which possesses perforations 56 in at least some regions. By means of the perforations 56 a proportion of the air 58 flowing onto and around the vertical tail unit 50 is drawn in via a pump 60 in the direction of the small white arrows and is exhausted again at another location (not indicated). By this means turbulence 62, i.e. vorticity, is to a large extent eliminated in the region of a surface 64 of the vertical tail assembly 50, and an essentially laminar flow ensues in the region of the leading edge 52 of the vertical tail unit 50, as a result of which its aerodynamically effective drag is reduced and the overall energy efficiency of the aircraft increases. For purposes of increasing the mechanical load capacity the suction component 54, in a deviation from the representation in FIG. 2, can also be formed with a correspondingly superplastically formed sandwich panel that is perforated on its outer surface (a so-called hollow component). The removal by suction of a proportion of the incident air 58 can then, for example, be undertaken by means of connecting webs forming passages between the surface layers of the sandwich panel. In a deviation from the vertical tail unit 50, cited in an exemplary manner, other active aerodynamic surfaces of an aircraft can also be fitted with similar suction components for purposes of extensive laminarisation of, in particular, the airflow near the surfaces.

By means of the inventive device 10 production is possible by means of superplastic forming of such suction components 54 with a complex three-dimensional spatial shape, using a simple, cost-effective and reliable process that is suitable for large production runs.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

REFERENCE SYMBOL LIST

10. Device
12. Upper mould
14. Lower mould
16. Blank
18. Perforations (blank)

20. Moulding tool
22. Upper cavity
24. Lower cavity
26. Depression
28. Drainage layer
30. Supply line
32. Supply unit
34. Suction line
36. Suction unit
38. Volumetric flow (gas)
40. Heating unit
42. Heating unit
44. Intermediate shape (blank)
46. Suction component
50. Vertical tail unit
52. Leading edge (vertical tail unit)
54. Suction component
56. Perforations (suction component)
58. Incident air
60. Pump
62. Turbulence
64. Surface (vertical tail unit)

The invention claimed is:

1. A device for the superplastic forming of a blank having perforations in at least some regions into a component, in a mould comprising:

a lower mould and an upper mould, wherein for purposes of forming, the blank can be subjected to pressure and temperature in the mould, and, wherein, the lower mould is formed at least partly with a permeable drainage layer, wherein the permeable drainage layer is gas permeable and is connected with a suction unit for gas.

2. The device in accordance with claim 1, wherein the component is a suction component, with a three-dimensional geometry.

3. The device in accordance with claim 1, wherein the upper mould is connected with a supply unit for a gas.

4. The device in accordance with claim 1, wherein, by means of the suction unit at least a volumetric flow of the gas passing through the perforations can be removed by suction.

5. The device in accordance with claim 1, wherein the drainage layer is formed with a surface structure.

6. The device in accordance with claim 5, wherein the drainage layer is formed with a fine mesh weave.

7. The device in accordance with claim 1, wherein the drainage layer is formed with a porous material.

8. The device in accordance with claim 7, wherein the drainage layer is formed with a sintered material.

9. The device in accordance with claim 1, wherein the drainage layer is an integral component of the lower mould.

10. The device in accordance with claim 1, wherein at least one supply line for gas is connected to the upper mould, which line is connected with a supply unit.

11. The device in accordance with claim 1, wherein the lower mould possesses at least one suction line for the gas, which is connected with the drainage layer and with the suction unit.

12. The device in accordance with claim 1, wherein at least one of the lower mould and the upper mould have a heating unit.

* * * * *